US005214807A

United States Patent [19]

Terve

[11] Patent Number: 5,214,807

[45] Date of Patent: Jun. 1, 1993

[54] VACUUM TOILET SYSTEM

[75] Inventor: Rolf Terve, Åhus, Sweden

[73] Assignee: Evac AB, Stockholm, Sweden

[21] Appl. No.: 688,738

[22] Filed: Apr. 18, 1991

[30] Foreign Application Priority Data

Apr. 20, 1990 [SE] Sweden ..... 9001401

[51] Int. Cl.[5] ..... E03D 1/00

[52] U.S. Cl. ..... 4/321; 4/323; 4/431

[58] Field of Search ..... 4/321, 323, 316, 431, 4/432, 433

[56] References Cited

U.S. PATENT DOCUMENTS

| | | | |
|---|---|---|---|
| 4,184,506 | 1/1980 | Varis et al. | 137/205 |
| 4,297,751 | 11/1981 | Olin et al. | 137/205 |
| 4,521,925 | 6/1985 | Chen et al. | 4/321 |
| 4,713,847 | 12/1987 | Oldfelt et al. | 4/317 |
| 4,783,859 | 11/1988 | Rozenblatt et al. | 4/321 |
| 4,791,688 | 12/1988 | Krishnakumar et al. | 4/321 |

*Primary Examiner*—Henry J. Recla
*Assistant Examiner*—David J. Walczak
*Attorney, Agent, or Firm*—Dellett, Smith-Hill and Bedell

[57] ABSTRACT

A vacuum toilet system comprises a small number of toilet bowls, a sewer, a small number of normally closed sewer valves connecting the toilet bowls respectively to the sewer, a sewage collecting tank in open communication with the sewer, a vacuum generator having a suction side in open communication with the sewer and operative to generate a partial vacuum in the tank and sewer, and a flush initiator associated with each toilet bowl for generating a toilet flushing impulse. A control unit is responsive to a toilet flushing impulse generated by the flush initiator associated with a given toilet bowl to cause the sewer valve connecting that toilet bowl to the sewer to open and the vacuum generator to operate for a predetermined time. In this fashion, a partial vacuum is generated in the tank and sewer of a level that depends on the free vacuum volume of the system.

20 Claims, 1 Drawing Sheet

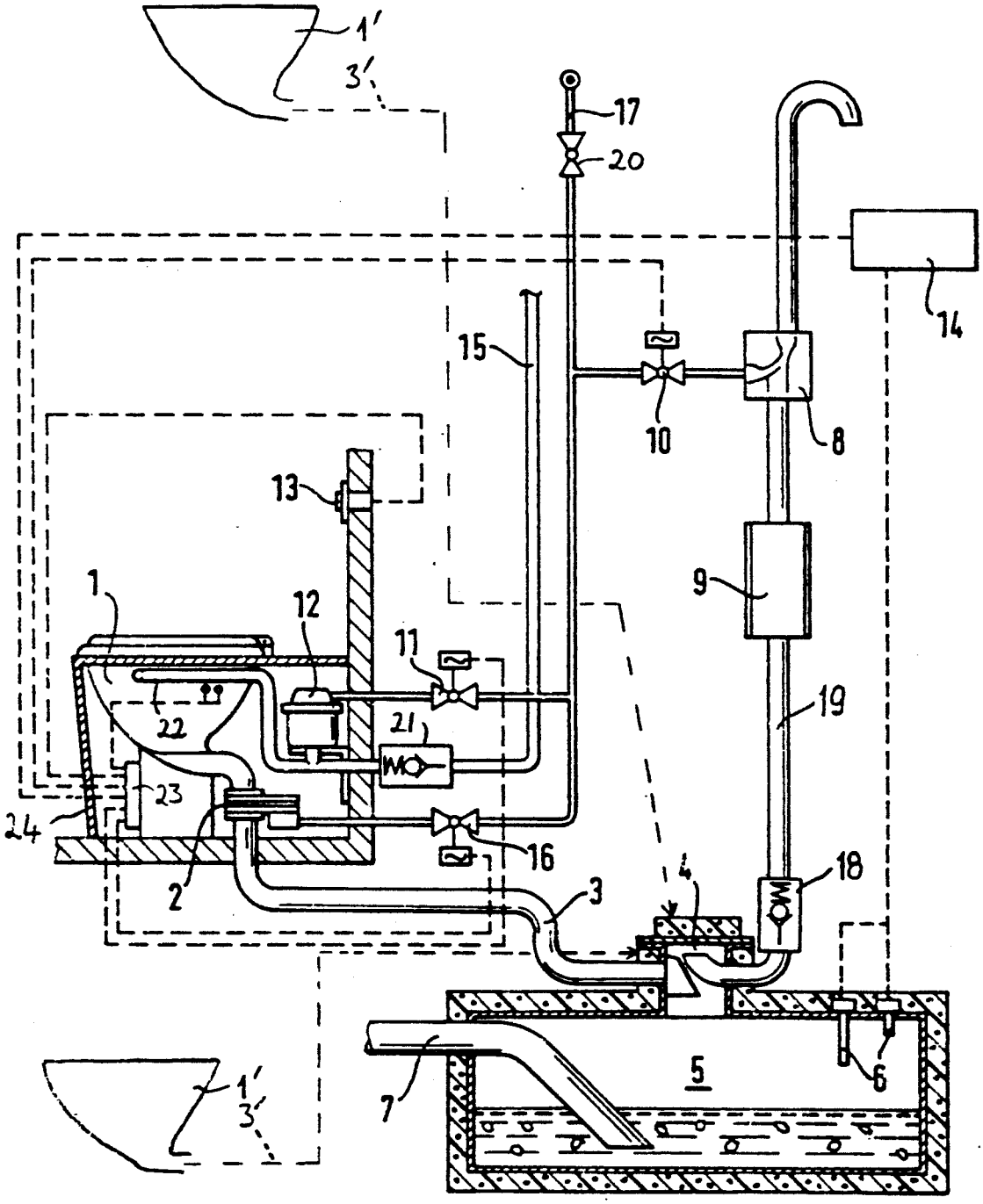
1'
3'
17
20
14
15
10
8
13
9
1
12
11
19
22
21
23
24
16
18
2
3
4
5
6
7
1'
3'

VACUUM TOILET SYSTEM

BACKGROUND OF THE INVENTION

This invention relates to a vacuum toilet system.

Vacuum toilet systems have been in use for many years. Because they require considerably less rinse water than conventional gravity toilet systems and employ small gauge piping and fittings, vacuum toilet systems have proved particularly useful for passenger transport applications such as in aircraft, ships and trains. Vacuum toilet systems are also being used increasingly in domestic housing projects.

A conventional vacuum toilet system comprises a number of waste receiving toilet bowls, each connected via a sewer valve to a sewer, which comprises a sewer main and sewer branches connected to the sewer valves respectively. The interior space of the sewer can be placed under a substantially lower pressure than exists in the interior of the toilet bowls. When a flush button associated with one of the toilet bowls is actuated, a disposal cycle is initiated. During the disposal cycle, the sewer valve is opened and pressure difference between the sewer and the interior of the toilet bowl causes waste in the toilet bowl to be evacuated from the toilet bowl into the sewer and transported to a sewage collecting tank, which is emptied from time to time. To assist in the evacuation of waste from the toilet bowl, and to improve cleanliness and hygiene, rinse water is fed into the bowl during the disposal cycle.

In order to achieve a satisfactory evacuation of waste from the toilet bowls, and to ensure effective waste transport through the sewer to the collecting tank, the level of vacuum in the sewer must exceed a minimum threshold value, which in many systems is about 40 kPa. As used in this description and in the appended claims, ambient pressure of a toilet bowl means the pressure existing in the toilet compartment that contains the toilet bowl, and vacuum level in a sewer means the amount by which the pressure in the sewer is below ambient pressure of a toilet bowl served by the sewer. In a large vacuum toilet system, such as the one described in U.S. Pat. No. 4,184,506, a constant partial vacuum is continuously maintained in the sewer. In a small system, for example having only one or two toilet bowls, such as is described in U.S. Pat. No. 4,297,751, the volume that must be put under vacuum is relatively small, and in this case the necessary vacuum can be satisfactorily generated each time a disposal cycle is initiated and need not be maintained continuously.

In a conventional small vacuum toilet system, the vacuum generator starts operating when a disposal cycle is initiated and continues to operate until a vacuum measuring device detects that a predetermined level of vacuum has been obtained. Thus, the vacuum generator operates for as long as necessary to produce the predetermined level of vacuum. The length of this operating time will vary according to the free vacuum volume of the system, that is, the volume that is placed under vacuum by operation of the vacuum generator.

In a system in which the sewer is in open communication with the sewage collecting tank, the free vacuum volume is composed of the volume of the sewer and the portion of the volume of the tank that is not occupied by waste, and depends on the level of liquid present in the tank. The smaller the system is, the greater is the relative change in the free vacuum volume of the system as the volume of sewage in the tank changes, because the tank volume is large in comparison to the volume of the sewer. Particularly in a small system of this kind, the optimum vacuum, that is, the vacuum required for reliably achieving a satisfactory evacuation of waste from a toilet bowl and ensuring its effective transport through the sewer to the collecting tank, is not constant but varies according to the free vacuum volume. At low tank liquid level (large free vacuum volume), a smaller vacuum is sufficient, and at high tank liquid level (small free vacuum volume) a greater vacuum is required. Hence, the constant vacuum level generated in a conventional vacuum toilet system is not the optimum solution for a small system of the kind referred to.

To solve the problem of always obtaining an optimum vacuum level, a control system responsive to the level of liquid in the collecting tank could be used to adjust the operating time of the vacuum generator. However, a control system to provide a varying operating time would be expensive and, due to its complexity, might not be totally reliable. The problem, therefore, is to design a small vacuum toilet system of the kind referred to, in which the level of vacuum generated on each disposal cycle is not constant but is dependent on the free vacuum volume in a functionally favorable way, without unduly increasing the cost of such a system or reducing its reliability.

SUMMARY OF THE INVENTION

It has been found that by controlling the vacuum generator so that its operating time is substantially constant, the level of vacuum achieved on each disposal cycle is at or close to the optimum for the actual free vacuum volume of the system. Thus, by maintaining a constant operating time for the vacuum generator in each disposal cycle, the vacuum level that is achieved provides the most efficient operation of the system.

To establish the most favorable constant operating time of the vacuum generator, it is convenient to operate the vacuum generator of the system with the sewer and collecting tank empty, and observe how long it takes to achieve a vacuum level suitable for waste transport. Experiment has shown that, in a small vacuum toilet system such as described, a vacuum level of at least 22 kPa. will normally provide satisfactory results when the sewer and collecting tank are empty. The time taken to reach this vacuum level with the tank empty can then be used as the predetermined operating time for that particular system, and it will always produce the optimum operating vacuum for the system, irrespective of the liquid level of the collecting tank.

Experiment has also shown that the most satisfactory size of collecting tank for a system according to the invention and comprising one or two toilet bowls is 120 to 600 liters, preferably 200 to 500 liters. Normally the vacuum generator should have the capacity of producing the required vacuum level of 22 kPa when the sewer and tank are empty in 6 seconds or less, preferably in no more than 4 seconds.

In order to ensure that the system operates effectively, the minimum free vacuum volume of the system should be at least 30 liters. Effective plug transportation of sewage through the sewer can be achieved if the sewer has a free inner diameter of between 40 and 70 mm, preferably between 44 and 65 mm. Thus, the sewer only contributes a few liters to the free vacuum volume of the system per meter of sewer. It is desirable that the waste be transported from the toilet bowl to the tank in a single disposal cycle, and this may be achieved if the length of the sewer between the sewer valve and the collecting tank is no more than 20 meters, preferably no more than 15 meters. In a system of this kind, the sewer does not contribute an undesirably large volume for the vacuum generator to evacuate.

If sewage splashes when it enters the collecting tank, there is a possibility that sewage will enter the air outlet of the collecting tank and block the vacuum generator. In order to reduce the possibility of splashing, it is desirable to limit the extent to which the collecting tank is filled. A collecting tank in the range 120 to 200 liters should normally not be filled to more than 80% of its volume, a tank of 200 to 300 liters to more than 85%, and a tank of more than 300 liters to more than 90%.

The collecting tank is preferably fitted with an alarm system to give warning when the level of liquid in the tank reaches the critical point for that size of tank, so that is may be emptied before the operation of the system is adversely affected.

BRIEF DESCRIPTION OF THE DRAWING

The invention will now be described in more detail with reference to the accompanying drawing, the single figure of which is a diagrammatic illustration of a vacuum toilet system embodying the invention.

DETAILED DESCRIPTION

The vacuum toilet system illustrated in the drawing is designed for installation in a passenger transport vehicle such as a railroad car or the like and comprises a toilet bowl 1 connected to a sewer 3 via a normally closed sewer valve 2. The sewer valve is operated by compressed air. For example, the sewer valve might employ a rotating disc driven by a compressed air motor. However, another type of sewer valve, including an electrically operated valve, may be used instead. Compressed air for operating the sewer valve 2 is supplied from a compressed air system 17 through a normally open valve 20 and a solenoid valve 16. The toilet bowl may be provided with a level sensor to detect and warn of flooding of the toilet bowl. The sewer 3 feeds into a collecting tank 5 via an air separator 4. The collecting tank 5 may be emptied by applying suction to a discharge pipe 7.

Rinse water from a water pipe 15 fills a pressurizer 12 through a check valve 21. The pressurizer 12 is connected to a spray ring 22 located inside the toilet bowl. The pressure of water in the water pipe 15 is sufficient to fill the pressurizer 12 without overflowing into the toilet bowl through the spray ring 22. Alternatively, the pressurizer might include a level-responsive valve. The pressurizer is connected to the compressed air source 17 through a solenoid valve 11. When the valve 11 is opened, compressed air forces the water from the pressurizer into the toilet bowl through the spray ring.

An ejector 8 is operated by compressed air fed from the compressed air source 17 through a solenoid valve 10. The suction side of the ejector 8 is connected to the tank 5 through a filter 9, a duct 19 and a check valve 18 for placing the sewer 3 and the tank 5 under vacuum. Naturally, the discharge pipe 7 is provided with a valve (not shown), for closing the discharge pipe. Further the tank is provided with an air inlet valve (not shown) to allow air to enter the tank when suction is applied to the discharge pipe.

The solenoid valves 10, 11 and 16 are connected to an interface unit 23 located inside the toilet shroud 24. A flush knob 13 on the toilet compartment wall is also connected to the interface unit 23. The interface unit is in turn connected to a control unit 14. The control unit 14 controls the various functions of the system and includes a timer.

To initiate a disposal cycle, the flush knob 13 is pressed and a pulse is sent to the control unit 14. The control unit responds to the pulse from the flush knob 13 by starting the timer. The timer then executes a predetermined operating cycle. The timer first opens the solenoid valve 10, which supplies compressed air to the ejector 8, thus generating a partial vacuum in the collecting tank 5 and sewer 3 within a few seconds. The solenoid valve 10 remains open for a predetermined time that is set by the timer and does not change in response to the volume of sewage in the tank 5. Operation of the ejector generates a level of vacuum that depends on the level of liquid in the collecting tank 5. At a fixed point in the operating cycle the control unit opens the solenoid valve 11, supplying compressed air to pressurizer 12. The water in pressurizer 12 is expelled into the toilet bowl 1 by way of spray ring 22. The control unit also opens the solenoid valve 16, whereby compressed air is supplied to the sewer valve 2 thereby opening it to allow waste in the toilet bowl to be forced out into the sewer 3 by the pressure difference between the toilet compartment and the sewer and to be transported by this pressure difference to the collecting tank 5.

The collecting tank 5 is provided with two level sensors 6, which detect when the level of waste in the tank reaches predetermined lower and upper levels. The level sensors are connected to an alarm indicator in the control unit 14. When the free surface of waste in the tank reaches the lower level, the alarm indicator provides a pre-alarm warning that the tank requires emptying. When the free surface reaches the upper level, the alarm indicator provides an alarm signal indicating that the toilet system must not be used until the tank is emptied.

The check valve 18 is provided between the filter 9 and the tank 5 to prevent backflow of air through the ejector 8 and the filter 9, and thus preserve vacuum in the tank 5 and sewer 3.

Further toilets with associated piping and other equipment may be connected to the collecting tank 5 and ejector 8, as shown schematically in the drawing by the toilet bowls 1' and the sewer branches 3'. Of course, in a system with multiple toilets, each having its own sewer valve 16, the control unit must coordinate operation of the sewer valves 16 with operation of the valve 10 to ensure that when the sewer valve associated with a given toilet bowl opens, there is sufficient vacuum in the sewer to evacuate waste from the toilet bowl. For example, the control unit might include a timer associated with each toilet and be arranged so that the operating cycle for a given timer cannot start while any other timer is still operating. In a small system of the kind to which the invention relates, this does not present a problem since the disposal cycle lasts only about 10 seconds.

The number of toilets served by a vacuum toilet system in which the sewer is in open communication with the collecting tank affects the free vacuum volume both through the volume of sewer that must be used to provide a connection to each toilet bowl and through the volume of the collecting tank required in order to maintain a reasonable interval between emptying of the collecting tank. The invention requires that the vacuum generator be operated in response to each flushing impulse. This implies that the system must have a small number of toilets, because as the number of toilet bowls served increases, it becomes less practical to evacuate the system each time a disposal cycle is initiated. The maximum number of toilets in one system is normally four, and is preferably only two.

The invention is not restricted to the embodiment described, but variations and modifications thereof are feasible within the scope of the attached claims.

I claim:

1. A small vacuum toilet system comprising a toilet bowl, a sewer, a normally closed sewer valve connecting the toilet bowl to the sewer, a sewerage collecting tank in open communication with the sewer, a vacuum generator having a suction side in open communication with the sewer and operative to generate a partial vacuum in the tank and sewer, and control means responsive to toilet flushing impulses to cause the vacuum generator to operate for a constant evacuation time in response to each flushing impulse, whereby on each flushing impulse a partial vacuum is generated by the vacuum generator in the free volume of the tank and sewer, said partial vacuum being of a level that due to said constant evacuation time is dependent on and varies in relation to the magnitude of said free vacuum volume at each separate flushing.

2. A vacuum toilet system according to claim 1, comprising a plurality of toilet bowls.

3. A vacuum toilet system according to claim 2, comprising no more than four toilet bowls.

4. A vacuum toilet system according to claim 1, wherein said constant time is such that operation of the vacuum generator for said predetermined time when the sewer and collecting tank are empty achieves a vacuum level in the tank and sewer of at least 22 kPa.

5. A vacuum toilet system according to claim 4, wherein said vacuum generator has a vacuum producing capacity such that said constant evacuation time no more than 6 seconds.

6. A vacuum toilet system according to claim 1, wherein said vacuum generator has a vacuum producing capacity such that said constant evacuation time is no more than 6 seconds.

7. A vacuum toilet system according to claim 1, wherein said sewage collecting tank has a volume of between 120 and 600 liters.

8. A vacuum toilet system according to claim 7, wherein the sewage collecting tank has a volume of between 200 and 500 liters.

9. A vacuum toilet system according to claim 8, wherein the system comprises means for providing an alarm signal when the tank is filled to a predetermined level, and the total free vacuum volume in the sewer and the sewage collecting tank when the tank is filled to the predetermined level is at least 30 liters.

10. A vacuum toilet system according to claim 7, wherein the sewage collecting tank has a volume between 120 and 200 liters and the system comprises means for providing an alarm signal before or when the tank is about 80% full.

11. A vacuum toilet system according to claim 7, wherein the sewage collecting tank has a volume of between 200 and 300 liters and the system comprises means for providing an alarm signal before or when the tank is about 85% full.

12. A vacuum toilet system according to claim 7, wherein the sewage collecting tank has a volume of more than 300 liters and the system comprises means for providing an alarm signal before or when the tank is about 90% full.

13. A vacuum toilet system according to claim 1, wherein the length of the sewer between the sewer valve and the sewage collecting tank is no more than 20 meters.

14. A vacuum toilet system according to claim 13, wherein the length of the sewer is no more than 15 meters.

15. A vacuum toilet system according to claim 1, wherein the free inner diameter of the sewer is between 40 and 70 mm.

16. A vacuum toilet system according to claim 15, wherein the free inner diameter of the sewer is between 44 and 65 mm.

17. A vacuum toilet system comprising a small number of toilet bowls, a sewer, a small number of normally closed sewer valves connecting the toilet bowls respectively to the sewer, a sewage collecting tank in open communication with the sewer, a vacuum generator having a suction side in open communication with the sewer and operative to generate a partial vacuum in the tank and sewer, a flush initiator associated with each toilet bowl for generating a toilet flushing impulse, and control means responsive to each toilet flushing impulse generated by the flush initiator associated with a given toilet bowl to cause the sewer valve connecting that toilet bowl to the sewer to open and the vacuum generator to operate for a constant evacuation time, whereby a partial vacuum is generated by the vacuum generator in the free volume of the tank and sewer, said partial vacuum being of a level that due to said constant evacuation time is dependent on and varies in relation to the magnitude of said free vacuum volume at each separate flushing.

18. A vacuum toilet system according to claim 17, comprising no more than four toilet bowls.

19. A method of operating a small vacuum toilet system that comprises a toilet bowl, a sewer, a normally closed sewer valve connecting the toilet bowl to the sewer, a sewage collecting tank in open communication with the sewer, a vacuum generator having a suction side in open communication with the sewer, and means for generating a toilet flushing impulse to initiate a disposal cycle, said method comprising operating the vacuum generator for a constant evacuation time in response to each toilet flushing impulse, whereby a partial vacuum is generated by the vacuum generator in the free vacuum volume of the tank and sewer, said partial vacuum being of a level that due to said constant evacuation time is dependent on and varies in relation to the magnitude of said free vacuum volume at each separate flushing.

20. A method according to claim 19, wherein said constant evacuation time is such that the vacuum generator achieves a vacuum level of at least 22 kPa in the sewer when the sewer and collecting tank are empty.

* * * * *